US008807196B2

(12) United States Patent
Mullet et al.

(10) Patent No.: US 8,807,196 B2
(45) Date of Patent: Aug. 19, 2014

(54) MODULAR ANTI-REVERSIBLE POWER SPRING APPARATUS AND METHOD

(75) Inventors: Willis Jay Mullet, Gulf Breeze, FL (US); Darrin W. Brunk, Pensacola, FL (US)

(73) Assignee: Qmotion Incorporated, Pensacola, FL (US)

( * ) Notice: Subject to any disclaimer, the term of this patent is extended or adjusted under 35 U.S.C. 154(b) by 409 days.

(21) Appl. No.: 12/927,212

(22) Filed: Nov. 10, 2010

(65) Prior Publication Data

US 2012/0024485 A1 Feb. 2, 2012

Related U.S. Application Data

(63) Continuation-in-part of application No. 12/799,879, filed on May 4, 2010.

(51) Int. Cl.
*A47G 5/02* (2006.01)

(52) U.S. Cl.
USPC ..... 160/317; 160/318

(58) Field of Classification Search
USPC ..... 160/310, 313, 318, 309, 315, 317, 160/323.1, 325, 326, 170; 185/45, 37; 242/375
See application file for complete search history.

(56) References Cited

U.S. PATENT DOCUMENTS

| | | | | |
|---|---|---|---|---|
| 330,579 | A * | 11/1885 | Grimm | 160/303 |
| 1,298,716 | A * | 4/1919 | Hoover | 185/45 |
| 4,009,745 | A | 3/1977 | Erpenbeck | |
| 5,880,532 | A * | 3/1999 | Stopher | 290/1 E |
| 6,155,328 | A | 12/2000 | Welfonder | |
| 6,283,192 | B1 | 9/2001 | Toti | |
| 6,648,050 | B1 | 11/2003 | Toti | |
| 6,659,156 | B2 | 12/2003 | Wen et al. | |
| 6,854,503 | B2 | 2/2005 | Cross et al. | |
| 6,957,683 | B2 | 10/2005 | Toti | |
| 7,717,156 | B2 * | 5/2010 | Costello et al. | 160/317 |
| 8,299,734 | B2 * | 10/2012 | Mullet et al. | 318/255 |
| 8,302,655 | B2 * | 11/2012 | Lin | 160/315 |
| 2006/0137837 | A1 * | 6/2006 | Costello et al. | 160/317 |
| 2008/0202709 | A1 * | 8/2008 | Anderson et al. | 160/321 |
| 2008/0289777 | A1 * | 11/2008 | Costello et al. | 160/317 |
| 2010/0269988 | A1 * | 10/2010 | Mullet et al. | 160/310 |
| 2011/0203748 | A1 * | 8/2011 | Mullet et al. | 160/310 |
| 2011/0203754 | A1 * | 8/2011 | Mullet et al. | 160/405 |
| 2011/0272106 | A1 * | 11/2011 | Mullet et al. | 160/311 |
| 2012/0031571 | A1 * | 2/2012 | Mullet et al. | 160/310 |
| 2012/0090797 | A1 * | 4/2012 | Mullet et al. | 160/331 |
| 2012/0234956 | A1 * | 9/2012 | Lin | 242/371 |
| 2012/0281511 | A1 * | 11/2012 | Charbon | 368/142 |

FOREIGN PATENT DOCUMENTS

FR 2790031 A1 8/2000

* cited by examiner

*Primary Examiner* — David Purol
(74) *Attorney, Agent, or Firm* — Zarley Law Firm, P.L.C.

(57) ABSTRACT

In a shade system with a bracket supporting a shade storage roll, an anti-reversible power spring apparatus includes a biasing member and a housing with a receiver end and a connector end where the housing encloses the biasing member and the receiver end and the connector end contain the biasing member within the housing. A connector device is connected with the housing and a receiver device is connected with the housing where the connector is connectable with a receiver and where the receiver is connectable with a connector.

20 Claims, 6 Drawing Sheets

MODULAR ANTI-REVERSIBLE POWER SPRING APPARATUS AND METHOD

CROSS REFERENCE TO RELATED APPLICATIONS

This application is a Continuation in Part of U.S. patent application Ser. No. 12/799,879 filed May 4, 2010 entitled "Anti-Reversible Power Spring Apparatus and Method". The Applicants hereby claim the benefit of the non-provisional application under 35 U.S.C. §120. The entire content of the non-provisional application is incorporated herein by this reference.

FIELD OF THE INVENTION

This invention relates to shade systems and mechanisms and methods for assisting in the movement of the shade system. In particular, in accordance with one embodiment, the invention relates, in a shade system with a bracket supporting a shade storage roll, to a modular anti-reversible power spring apparatus including a biasing member and a housing with a receiver end and a connector end where the housing encloses the biasing member and the receiver end and the connector end contain the biasing member within the housing. A connector device is connected with the housing and a receiver device is connected with the housing where the connector is connectable with a receiver and where the receiver is connectable with a connector.

BACKGROUND OF THE INVENTION

A difficulty arises with the operation of shades for windows, doors and the like. In particular, shade systems include shade rolls to which the shade is attached. The shade is rolled onto the shade roll and dispensed from the roll and taken up by the roll as required. A major difficulty is caused by the requirements to keep the shade system small enough to not be obtrusive and to fit in the window or door space while still enabling the easy operation and movement of the shade. Motors are utilized to assist the movement of the shade but the weight of the shade can require very large, noisy and expensive motors.

Prior art devices abound that provide assistance to motors and to the operation of shade systems. In particular, roll type shades, curtains, and doors can be counterbalanced as has been known in the art. In Erpenbeck, U.S. Pat. No. 4,009,745, a window shade support roller having an improved spring motor construction and method of manufacture includes a spring retaining structure which holds a driving spring and a spear structure having an integral spear. The spear structure and the spring retaining structure cooperate together, and with a ball, to form a ball clutch mechanism. The spring retaining structure has ball-receiving recesses with canting floors which simplify assembly. Assembly steps include inserting balls into the spring retaining structure, inserting the spear structure into the spring retaining structure, inserting a dowel into the spear structure, positioning a spring around the dowel, and inserting one end of such spring between portions of the spring retaining structure, which uniquely capture and retain the end without other securement, for torsional winding of the spring. However this device must be mounted horizontally so gravity can move the balls in the channel of the ratchet surface arrangement. If the device is mounted vertically, such that there is no force from gravity the balls will not move in the channel.

In U.S. Pat. Nos. 6,283,192 and 6,957,683 to Toti, a spring drive system for window covers is disclosed which includes a so-called flat spring drive and the combination whose elements are selected from a group which includes (1) a band transmission which provides varying ratio power transfer as the cover is opened and closed; (2) a gear system selected from various gear sets which provide frictional holding force and fixed power transfer ratios; and (3) a gear transmission which provides fixed ratio power transfer as the cover is opened or closed. The combination permits the spring drive force at the cover to be tailored to the weight and/or compression characteristics of the window cover such as a horizontal slat or pleated or box blind as the cover is opened and closed. This art discusses the use of multiple drums with flat type springs but does not address the issue of possible back winding the spring.

In U.S. Pat. No. 6,648,050 to Toti, a spring drive system useful for window covers is disclosed, which comprises one or more coil spring drives or flat spring drives and the combination whose elements are selected from one or more of a group which includes (1) a band or cord transmission which provides varying ratio power transfer as the cover is opened and closed; (2) gear means comprising various gear sets which provide frictional holding force and fixed power transfer ratios; (3) a gear transmission which provides fixed ratio power transfer as the cover is opened or closed; (4) crank mechanisms; (5) brake mechanisms; and (6) recoiler mechanisms. The combination permits the spring drive force to be tailored to the weight and/or compression characteristics of an associated window cover such as a horizontal slat or pleated or box blind as the cover is opened and closed.

In U.S. Pat. No. 6,659,156 to Wen et al., a screw transmission mechanism for a motor-driven blind is constructed to include a driving unit, and at least one cord roll-up unit controlled by the driving unit to lift/lower or tilt the slats of the motor-driven Venetian blind. Each cord roll-up unit includes an amplitude modulation set controlled by the driving unit to lift/lower the slats and bottom rail of the Venetian blind, a frequency modulation set for rotation with the amplitude modulation set to tilt the slats of the Venetian blind, and a linkage adapted to control connection between the frequency modulation set and the amplitude modulation set.

In U.S. Pat. No. 6,854,503 to Cross et al., the invention includes an unbalanced horizontal blind with a spring means to provide a lifting or retraction force for the slats of the blinds. A brake means prevents undesired movement of the slats that would otherwise result from the continuous retraction force of the spring means when the slats are set in a desired position. Controls for the release of the brake means and tilting are also provided in an embodiment of a blind of the invention. An embodiment of the invention permits the blind to be operated by a single wand that can be used to either raise the slats or tilt the slats. This eliminates the need for a loose cord or bead chain that would traditionally be used as the user interface for controlling the movement of the slats of the blind.

Despite these efforts, the art is still missing a counter balancing system that is easily adjustable such that counter balances may be added or deleted as the circumstances require and as they change. That is, all the prior art of which Applicants are aware are fixed systems or complex adjustable systems that are bulky and hard to manipulate. At best prior art systems can accommodate small adjustments but major changes in the weight of the shade to be moved require total replacement of existing counter balances.

Another missing element in the prior art is a simple system for the prevention of back winding of the counter balance springs. For example, if some element of a prior art system was changed, like a battery or batteries, and then the shade was rehung partially deployed, this can result in a reverse wind of the counter balance spring when the motor moves the shade up to the fully open position. This is not desirable since it can, and often does, damage the counter balance systems in the prior art.

The cross referenced application goes a long way to eliminating the prior art problems but others still remain. It has been determined that the cross referenced housing limits the number of biasing members by its own dimensions. That is, while the housing may contain multiple biasing members only a certain definite number may be contained in any one preconstructed housing.

Further, in order to add or delete biasing members, the entire group of biasing members and the entire housing must be removed, the housing opened, the biasing member(s) added or removed, and then the housing resealed and reinserted for operational use.

Further, there is no way provided by the prior art to add additional housings within the system and, at the same time, ensure that the additions are secure with each other and within the system.

Thus, it is an object of this invention to provide a counter balance system and method that is modular and that is easy to install and adjust. Further it is an objective of the invention to provide a counter balance system that does not back wind and can not back wind during operation of a shade system.

SUMMARY OF THE INVENTION

Accordingly, according to one embodiment in a shade system with a bracket supporting a shade storage roll, a modular anti-reversible power spring apparatus includes a biasing member and a housing with a receiver end and a connector end where the housing encloses the biasing member and together the housing, the receiver end and the connector end contain the biasing member within the housing. A connector is connected with the housing and a receiver is connected with the housing where the connector is connectable with a receiver and where the receiver is connectable with a connector.

Terms used herein are given their common and ordinary meaning as known by those of ordinary skill in the art. "Modular" is used to describe a device that includes identical or nearly identical attributes such as form and dimension, for example only, such that one may be added to and removed from another, for example only, in a simple, predicable manner. "Connector" and "receiver" describe structures that cooperate together to hold two items together. Likewise "female connector" and "male connector" describe structures designed to cooperate with each other to secure one to the other. Further, "biasing member" describes a device that can exert pressure in a system to move it or resist movement, for example only, such as a spring, for example only and not by way of limitation.

In one aspect of the invention, a second housing enclosing a second biasing member is provided and a connector on one housing connects with a receiver on the other housing such that the two housings are locked together.

In another aspect, the invention further includes a support connected with the bracket, such that the support does not move. The support is also connected with the biasing member within the housing. A first end cap and a second end cap are provided where one end cap is connected to the shade storage roll at each end of the shade storage roll and also to the support such that the first end cap and the second end cap are held stationary along with the support but the shade storage roll is free to rotate about the end caps. Further, a connector is connected with the first end cap and a receiver is connected with the second end cap where, again, the connector is connectable with a receiver and the receiver is connectable with a connector.

As used herein, the term "connectable" means "capable of being connected" and describes a structure or combination of structures that provide the ability, when combined, to result in joining together, at least temporarily, two or more separate structures.

In one aspect, the biasing member further includes a first end and a second end where the first end of the biasing member is connected with the housing and where the second end of the biasing member is connected with the support. In a further aspect, the support has a length and the housing has a length and the support is conformed in length to approximately the length of the housing.

In one aspect of the invention, the shade storage roll includes a female connector and the housing includes a male connector and the male connector is conformed to connect with the female connector and to lock the housing with the shade storage roll.

In another aspect, the connection of the second end of the biasing member with the support is such that the biasing member is held in place when the housing rotates in one direction and is released when the housing rotates in an opposite direction. In a further aspect, the support includes a groove that accepts the second end and holds the second end against movement when the storage roll is rotated in one direction but which allows passage of the second end past the groove when the storage roll is rotated in the opposite direction.

In another aspect, the biasing member is selected from a group consisting of: a spring and a coiled flat spring.

According to another embodiment of the invention, in a shade system with a bracket supporting a shade storage roll, a modular anti-reversible power spring apparatus includes a biasing member and a housing with a receiver end and a connector end where the housing encloses the biasing member and the receiver end and the connector end contain the biasing member within the housing. A connector is provided that is connected with the receiver end and a receiver is provided that is connected with the connector end where the connector is connectable with a receiver and where the receiver is connectable with a connector. A support is connected with the bracket, such that the support does not move, and where the support is also connected with the biasing member within the housing. A first end cap and a second end cap are provided where one end cap is connected to the shade storage roll at each end of the shade storage roll and to the support such that the first end cap and the second end cap are held stationary with the support and the shade storage roll is free to rotate about the end caps. And a connector is connected with the first end cap and a receiver is connected with the second end cap where the first end cap connector is conformed to connect with the connector end receiver and the second end cap receiver is conformed to connect with the receiver end connector.

In one aspect of this invention, it further includes more than one housing with a biasing member where each housing is conformed to connect with at least one additional housing.

In another aspect, the biasing member further includes a first end and a second end where the first end of the biasing member is connected with the housing and where the second end of the biasing member is connected with the support. In one aspect, the support has a length and the housing has a length and the support is conformed in length to approximately the length of the housing. In a further aspect, the shade storage roll includes a female connector and the housing includes a male connector and the male connector is conformed to connect with the female connector and to lock the housing with the shade storage roll.

In a further aspect, the connection of the second end of the biasing member with the support is such that the biasing member is held in place when the housing rotates in one direction and is released when the housing rotates in an opposite direction. In another aspect, the support includes a groove that accepts the second end and holds the second end against movement when the storage roll is rotated in one direction but which allows passage of the second end past the groove when the storage roll is rotated in the opposite direction.

According to another embodiment of the invention, in a shade system with a bracket supporting a shade storage roll, a modular anti-reversible power spring method includes the steps of:

a. providing a biasing member; a housing with a receiver end and a connector end where the housing encloses the biasing member and the receiver end and the connector end contain the biasing member within the housing; a connector connected with the housing; and a receiver connected with the housing where the connector is connectable with a receiver and where the receiver is connectable with a connector; and b. connecting the housing with the shade storage roll.

In another aspect of this invention the method includes the steps of"

a. providing a support connected with the bracket, such that the support does not move, and also connected with the biasing member within the housing; a first end cap and a second end cap where one end cap is connected to the shade storage roll at each end of the shade storage roll and to the support such that the first end cap and the second end cap are held stationary with the support and the shade storage roll is free to rotate about the end caps; and a connector connected with the first end cap and a receiver connected with the second end cap where the first end cap connector is conformed to connect with a receiver and the second end cap receiver is conformed to connect with a connector; and b. connecting an end cap with a housing.

In one aspect, the biasing member further includes a first end and a second end where the first end of the biasing member is connected with the housing and where the second end of the biasing member is connected with the support such that the biasing member is held in place when the housing rotates in one direction and is released when the housing rotates in an opposite direction.

In another aspect, the method includes the steps of:

a. providing more than one housing with a biasing member where each housing is conformed to connect with at least one additional housing; and b. connecting each housing with at least one additional housing.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
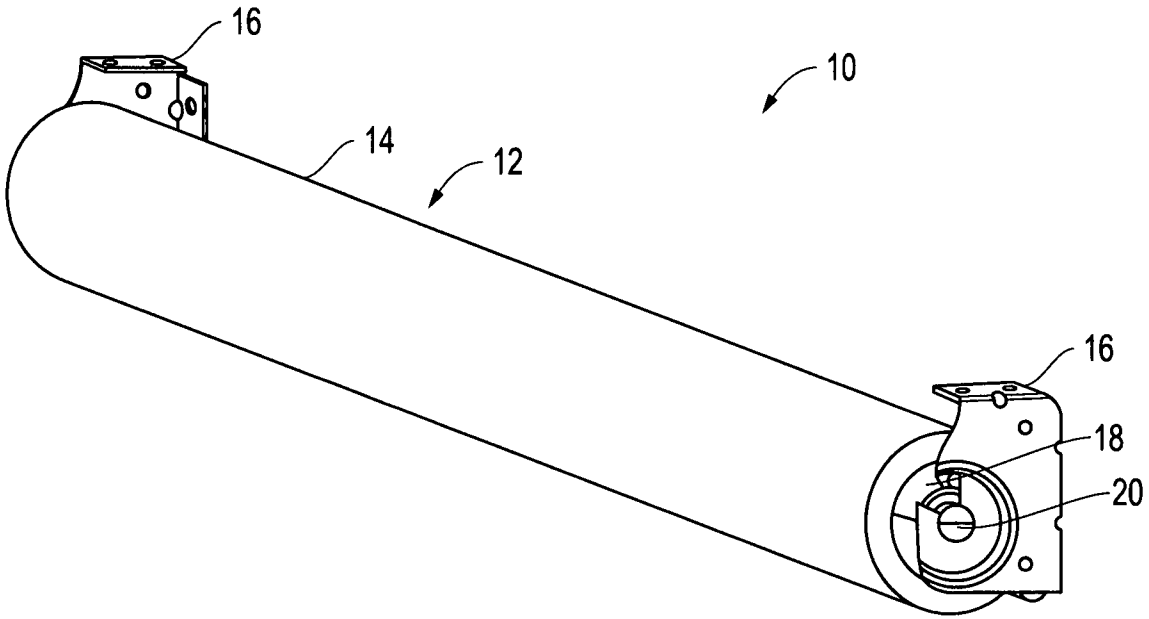
FIG. 1 is a perspective view of a shade roll and bracket assembly for the modular anti-reversible power spring apparatus of the present invention according to one embodiment.

The preferred embodiment of the present invention is illustrated by way of example in FIGS. 1-9. With specific reference to FIG. 1, the preferred embodiment of the modular anti-reversible power spring apparatus 10 of the present invention includes an associated roll shade assembly 12 consisting of a shade material 14, mounting bracket 16, a shade storage roll 18 and at least one arbor shaft or support 20. The shade material 14 is attached to the storage roll 18 as is known in the art. As used herein, the term "shade material" is used in its common manner to indicate a substance used to provide shade. It thus includes fabric and plastic, for example only and not by way of limitation, and any other flexible material now known or hereafter developed capable of being rolled onto and off of a storage roll.

Figure 2:
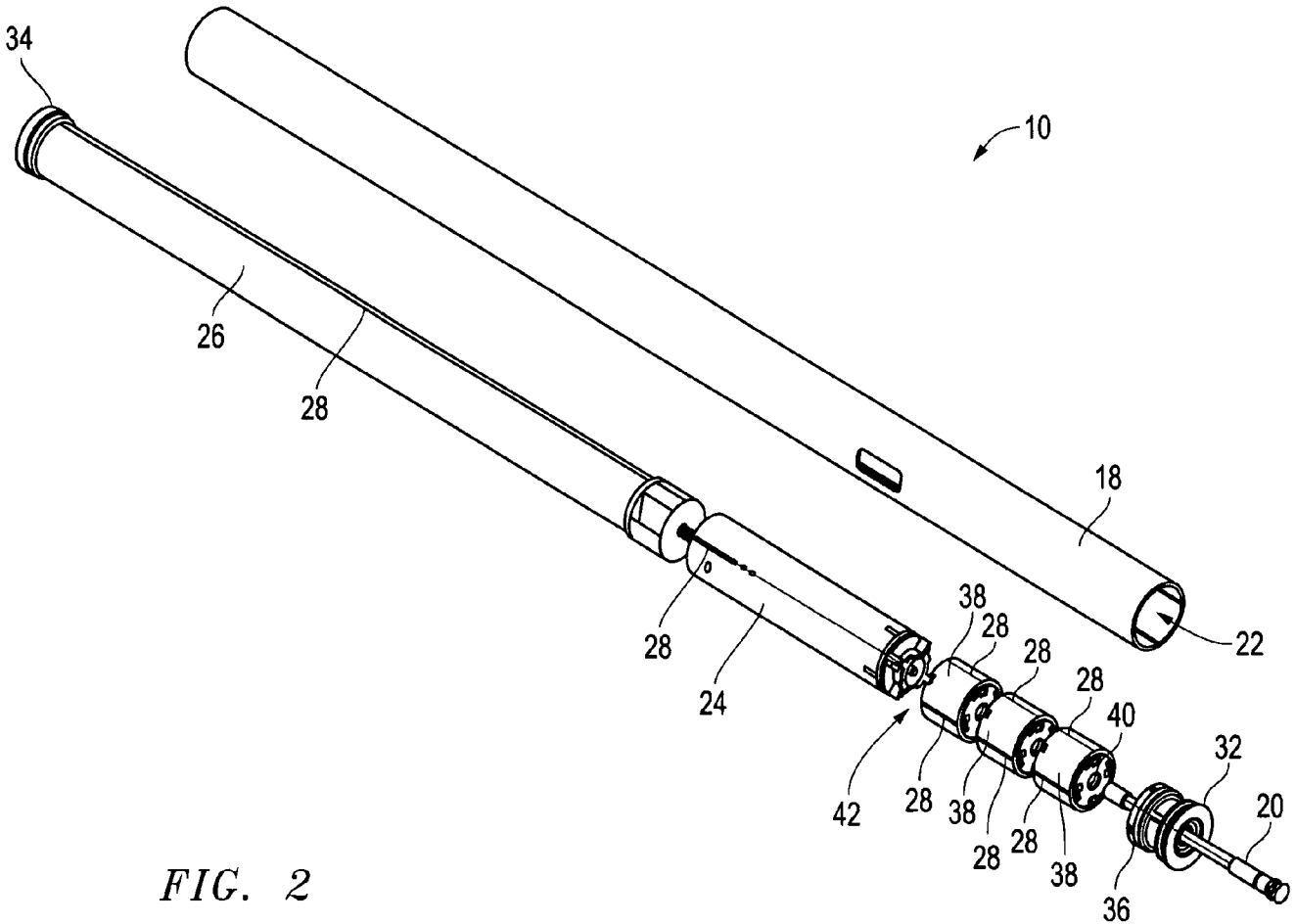
FIG. 2 is an exploded perspective view of the invention of FIG. 1 showing three separate housings each including one biasing member.
Figure 3:
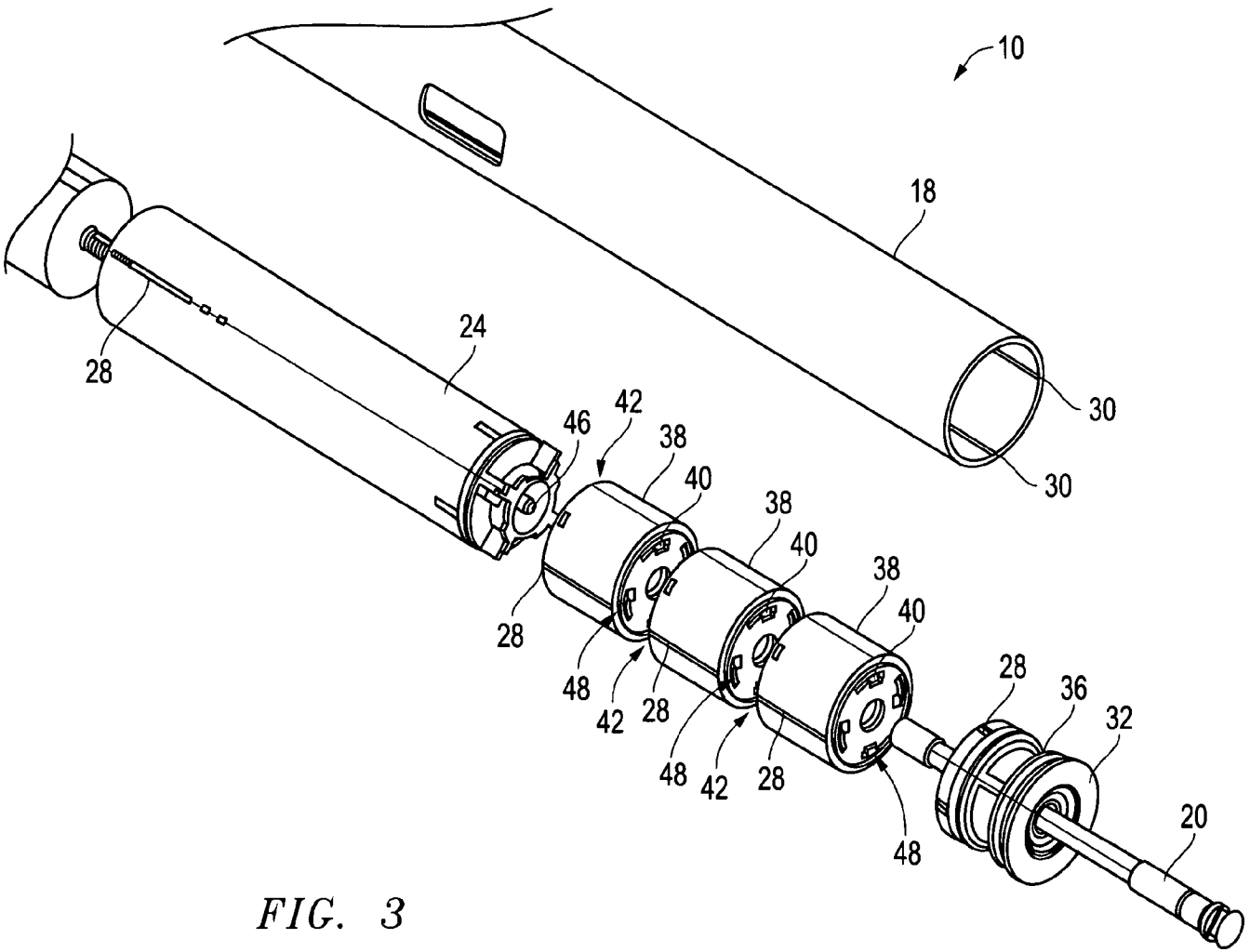
FIG. 3 is a close up, exploded perspective view of the invention of FIGS. 1 and 2.

Referring now to FIGS. 2 and 3, the inside of the storage roll 18, according to a preferred embodiment is hollow. It thus is capable of including within the hollow interior 22 many mechanisms such as, for example only, a motor assembly 24, including a motor and gearbox (not shown) for example, and a power supply 26, including batteries (not shown) for example only. The motor assembly 24 and the power supply 26 have one or more male connectors 28, such as a spline or ridge as shown for example only, that mate with an internal longitudinal groove(s) or female connector 30 in the interior surface of the hollow interior 22 of storage roll 18. The figures show one or two longitudinal female connectors 30 but there may be more. The effect of inserting motor assembly 24 and power supply 26 within the hollow interior 22 of storage roll 18, by aligning the male connector 28 with the female connectors 30, is to lock the elements together such that the motor assembly 24 and the power supply 26, and any and all other elements connected in such a manner with storage roll 18 as will be discussed more fully hereafter, turn with the storage roll 18.

Still referring to FIGS. 2 and 3, in a preferred embodiment, a first end cap 32 and a second end cap 34 are provided. First end cap 32 is connected with support 20 and storage roll 18 on one end of storage roll 18 and second end cap 34 is connected with support 20 and storage roll 18 on the other end of storage roll 18 as illustrated. The connection of support 20 with mounting bracket 16 is fixed. That is, support 20 does not move with relation to bracket 16 once it is secured thereto. Likewise, support 20 is connected with first end cap 32 and second end cap 34 in a fixed relation such that once secured in place, the end caps 32 and 34 do not move either. Storage roll 18, however, although it is supported between and by the two end caps 32 and 34 is free to move in relation to the end caps 32 and 34. This movement may be facilitated by the use of bearings 36 at end caps 32 and 34, for example only. In this manner, output from motor assembly 24 which is connected with storage roll 18 as described above, turns shade roll 18 about end caps 32 and 34 when power from power supply 26 is applied.

Finally, FIGS. 2 and 3 illustrate housing 38 with a receiver end 40 and a connector end 42. Preferably, housing 38 is cylindrically shaped and similar in dimension to the inside diameter of storage roll 18. Together, housing 38 and receiver end 40 and connector end 42 enclose biasing member 44 (see FIGS. 4 and 5) and retain biasing member 44 inside housing 38. Here it should be noted that housing 38 encloses only a single biasing member 44 as will be described more fully hereafter. The figures also show that, preferably, housing 38 includes male connectors 28 that cooperate with female connectors 30 to secure housings 38 in place within storage roll 18, as discussed above with regard to the motor assembly 24 and the power supply 26. And, the figures show that preferably, support 20 is connected with each housing 38 as will be described more fully hereafter.

Referring now to FIG. 3, this close up view further illustrates some of the features of the present invention such as receiver end 40 connected with housing 38. Connector end 42 is not shown (see FIG. 4) but is opposite from receiver end 40 and connected with housing 38 as well.

Further, it can be seen that support 20 is conformed, according to a preferred embodiment, to pass through first end cap 34 and housings 38 and to connect with power out put shaft 46. Again, because support 20 is fixed and does not move, and because motor assembly 24 is connected with storage roll 18, which is allowed to move, when operated power out put shaft 46 turns storage roll 18.

Figure 4:
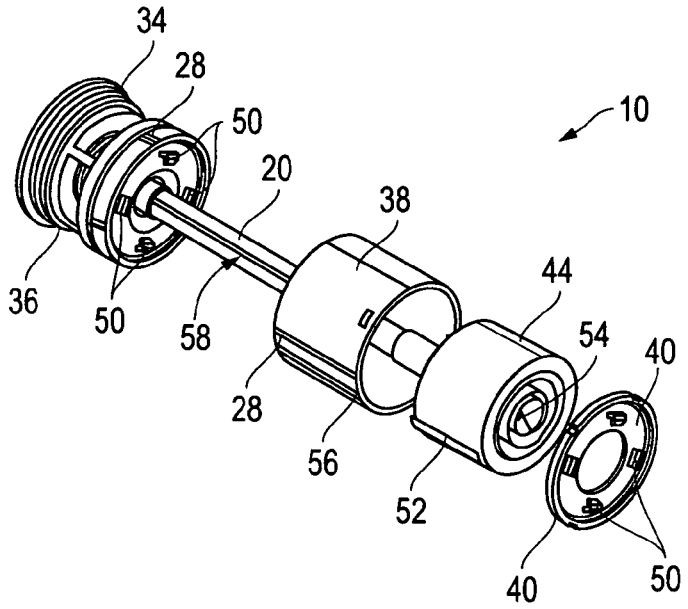
FIG. 4 is a close up, exploded perspective view of one end cap and one housing with one biasing member.

Importantly, FIG. 3 also clearly illustrates receiver 48. Receiver 48 preferably consists of one or more keyed slots as illustrated. FIG. 4 shows connector 50. Connector 50 preferably consists of one or more extended keys as illustrated. Connector 50 cooperates with receiver 48 to lock two separate housings together, as will be discussed more fully hereafter.

Figure 5:
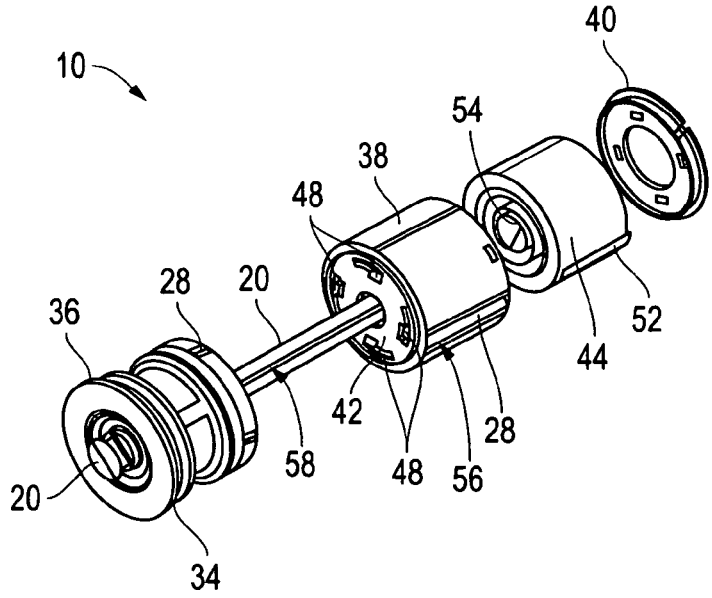
FIG. 5 is a close up, exploded perspective view of FIG. 4 from the opposite view from FIG. 4.

Referring now to FIGS. 4 and 5, many of the above features are more clearly illustrated along with a clear view of the biasing member 44. Preferably, biasing member 44 is a spring, such as a coiled, flat spring as shown. Biasing member 44 has a first end 52 and a second end 54. The first end 52 is connected with housing 38. Preferably, first end 52 fits within slot 56 in housing 38 and is held in that position after installation.

Second end 54 fits within groove 58 on support 20. Importantly, second end 54 and groove 58 cooperate together to prevent movement between them when housing 38 rotates with storage roll 18 in one direction. However, second end 54 is released from groove 58 when rotated in the opposite direction as is more clearly seen from FIG. 6 and as will be discussed more fully hereafter.

Another important feature of the present invention is shown in FIGS. 4 and 5 in which second end cap 34 includes connectors 50 as described above. As a result, connectors 50 on second end cap 34 cooperate with receivers 48 on connector end 42 of housing 38 to secure housing 38 to the end cap 34. First end cap 32 (not shown) may also include connectors 50 for the same purpose. Obviously, it is not essential to the invention which element has the connectors 50 and which has the receivers 48 but only that they are positioned so as to function as described. Nonetheless, this feature of the invention ensures that housings 38 inserted within storage roll 18 do not travel or move along the hollow interior 22 after insertion. This is a decided advantage over the prior art in that is reduces noise and vibration as Applicants have determined by testing.

FIG. 5 clearly shows connector end 42 of housing 38 with receivers 48.

Figure 6:
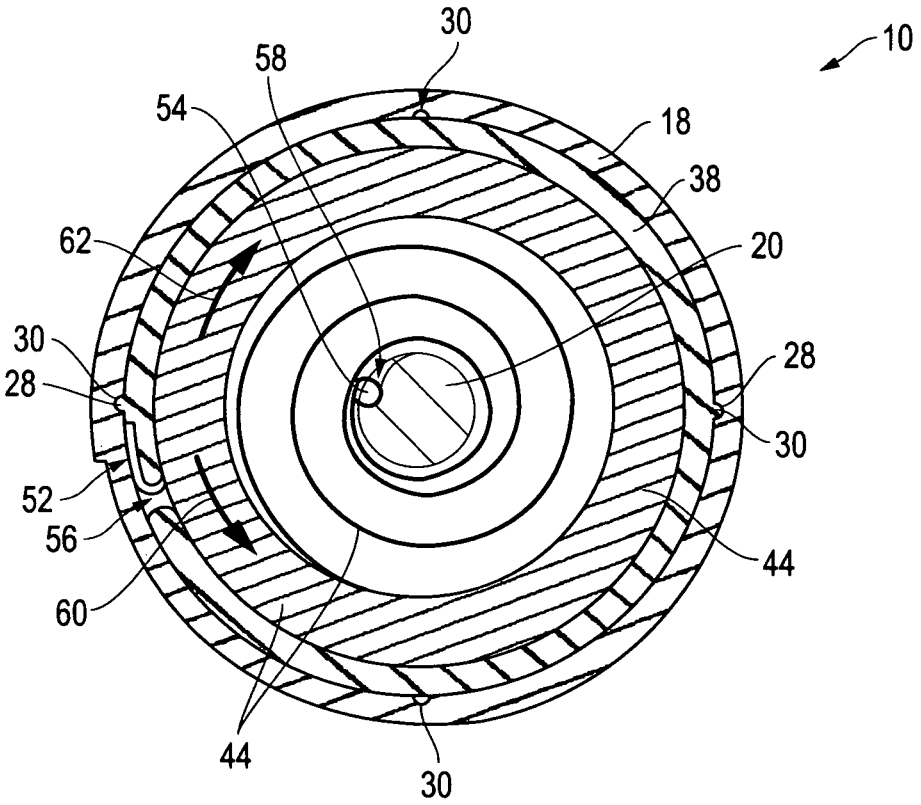
FIG. 6 is an end section view of the invention.

Referring now to FIG. 6 a cross section view shows storage roll 18 with female connectors 30 and housing 38 with male connectors 28 connected within female connectors 30. Four female connectors 30 are shown in the cross section and only two male connectors 28, which is acceptable for the purposes of the invention.

Slot 56 in housing 38 is clearly shown as is first end 52 of biasing member 44. Also shown are second end 54 of biasing member 44 formed, for example into a rounded end and set within groove 58 of support 20. In this position, when rotated in the direction of direction arrow 60 the second end 54 is held against movement by groove 58 in stationary support 20 and the biasing member 44 is wound up. When rotated in the direction of direction arrow 62, the opposite direction from arrow 60, the second end 54 ramps over the top of groove 58 and unwinds. This feature of the invention prevents reverse or back winding of the biasing member 44.

Figure 7:
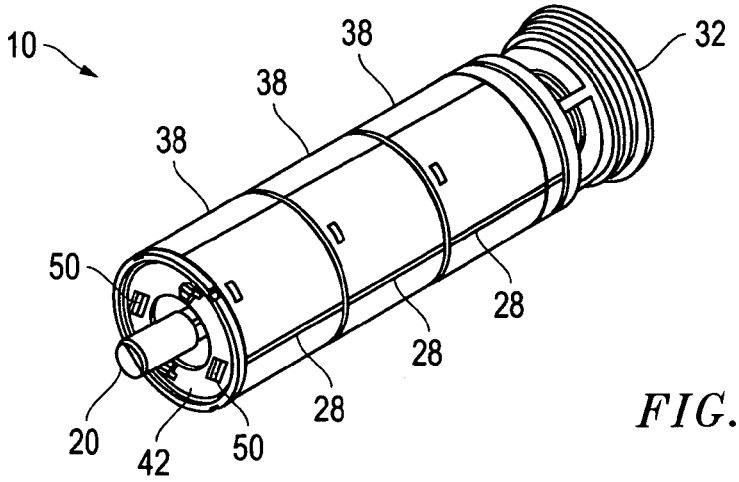
FIG. 7 is a side perspective view of the invention showing three housings and a support approximately the same length as the total length of the three separate housings.
Figure 8:
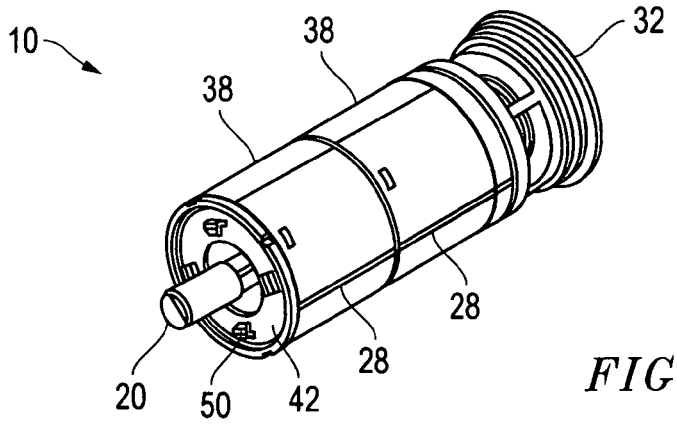
FIG. 8 is a side perspective view of the invention showing two housings and a support approximately the same length as the total length of the two separate housings.
Figure 9:
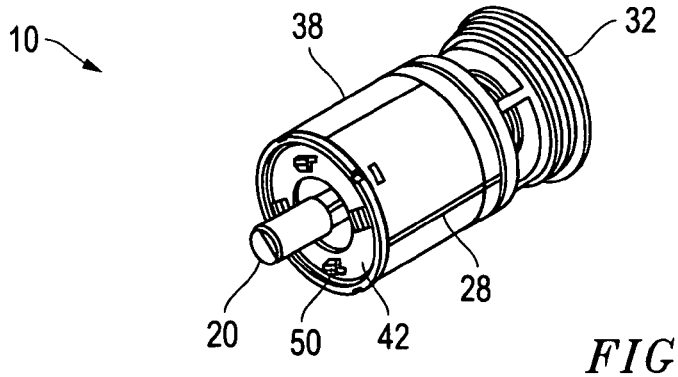
FIG. 9 is a side perspective view of the invention showing one housing and a support approximately the same length as the total length of the one housing.

Referring now to FIGS. 7, 8, and 9 it is illustrated that support 20 has a length and the length of support 20 may, according to one embodiment, be approximately the same as the combined length of the total number of housings 38, each with a single biasing member 44. FIG. 7 shows support 20 approximately as long as three combined housings 38, FIG. 8, two and FIG. 9 only one. Certainly, support 20 may be of a single length sufficient to retain multiple housings 38 covering its entire length or not. That is, fewer housings 38 are easily accommodated on a long support 20 and, as described above, held in place along the support 20 just as well without need for changing to a support 20 of a different length.

In whatever length, the important feature of the invention is that housings 38 and the single enclosed biasing member 44 may easily be added to or removed from the storage roll 18. This is a tremendous advantage over the prior art which requires complicated removal of a large housing, if present, opening the housing, adding or removing biasing members 44 re-closing and re-installing the housing. According to the present invention, counterbalance tension as provided by the biasing members 44 may be accurately and easily adjusted to fit the needs. Further repair and replacement is just as easily accommodated.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In a shade system with a bracket supporting a shade storage roll having a shade, and a modular anti-reversible power spring apparatus, the shade system comprising:

a first housing having an exterior surface, a receiver end and a connector end wherein the first housing encloses a first anti-reversible biasing member;

at least one connector connected with the connector end of the first housing;

at least one receiver connected with the receiver end of the first housing;

the first anti-reversible biasing member having a first end and a second end wherein the first end is connected to the first housing and the second end includes a feature;

a second housing having an exterior surface, a receiver end and a connector end wherein the second housing encloses a second anti-reversible biasing member;

at least one connector connected with the connector end of the second housing;

at least one receiver connected with the receiver end of the second housing;

the second anti-reversible biasing member having a first end and a second end wherein the first end is connected to the second housing and the second end includes a feature;

wherein the at least one connector of the first housing and the at least one receiver of the second housing selectively lock the first housing and the second housing together thereby preventing unintentional separation of the first housing and the second housing;

wherein the first housing and the second housing are connected to the shade storage roll;

a support connected with the bracket;

the support having a groove;

wherein the feature of the first anti-reversible biasing member is received within the groove of the support and the feature of the second anti-reversible biasing member is received within the groove of the support;

wherein the shade storage roll rotates around the support;

wherein when the shade storage roll is rotated in a first direction, the feature of the first anti-reversible biasing member and the feature of the second anti-reversible biasing are held in place in the groove of the support;

wherein when the shade storage roll is rotated in a second direction, opposite the first direction, the groove of the support allows passage of the feature of the first anti-reversible biasing member and the feature of the second anti-reversible biasing member out of the groove so as to prevent reverse or back winding of the first anti-reversible biasing member and the second anti-reversible biasing member.

2. The apparatus of claim 1 wherein the feature of the first anti-reversible biasing member is a rounded end, and the feature of the second anti-reversible biasing member is a rounded end.

3. The apparatus of claim 1 further including:

a first end cap and a second end cap wherein the first end cap is connected to the shade storage roll at a first end, and the second end cap is connected to the shade storage roll at a second end such that the first end cap and the second end cap are held stationary with said storage roll and rotate about the support with the storage roll.

4. The apparatus of claim 1 further comprising:

a third housing having an exterior surface, a receiver end and a connector end wherein the third housing encloses a third anti-reversible biasing member;

at least one connector connected with the connector end of the third housing;

at least one receiver connected with the receiver end of the third housing;

the third anti-reversible biasing member having a first end and a second end wherein the first end is connected to the second housing and the second end includes a feature;

wherein the at least one connector of the second housing and the at least one receiver of the third housing selectively lock the second housing and the third housing together thereby preventing unintentional separation of the first housing, the second housing and the third housing.

5. The apparatus of claim 1 wherein the groove of the support has a first side and a second side;

wherein the first side of the groove is sharp or concave in shape so as to hold the feature of the first anti-reversible biasing member when rotated in a first direction;

wherein the second side of the groove is smooth or convex in shape so as to allow the feature of the first anti-reversible biasing member to ramp over the groove when rotated in a second direction.

6. The apparatus of claim 1 wherein an interior surface of the shade storage roll includes a male or female connector and the exterior surface of the first housing includes a corresponding male or male connector and wherein the male or female connector of the first housing is conformed to connect with the male or female connector of the shade storage roll and to lock the first housing with the shade storage roll.

7. The apparatus of claim 1 further comprising a motor assembly positioned within the shade storage roll.

8. The apparatus of claim 1 further comprising a power supply positioned within the shade storage roll.

9. The apparatus of claim 1 wherein the first anti-reversible biasing member is selected from a group consisting of: a spring and a coiled flat spring.

10. In a shade system with a bracket supporting a shade storage roll, a modular anti-reversible power spring apparatus comprising:

a first housing having an exterior surface, a receiver end and a connector end wherein the first housing encloses a first anti-reversible biasing member;

the first anti-reversible biasing member having a first end and a second end wherein the first end is connected to the first housing and the second end includes a feature;

a second housing having an exterior surface, a receiver end and a connector end wherein the second housing encloses a second anti-reversible biasing member;

the second anti-reversible biasing member having a first end and a second end wherein the first end is connected to the second housing and the second end includes a feature;

wherein the first housing and the second housing selectively lock to one another thereby preventing unintentional separation of the first housing and the second housing;

wherein the first housing and the second housing are connected to the shade storage roll;

a support connected with the bracket;

the support having a groove;

wherein the feature of the first anti-reversible biasing member is received within the groove of the support; and the feature of the second anti-reversible biasing member is received within the groove of the support;

wherein the shade storage roll rotates around the support;

wherein when the shade storage roll is rotated in a first direction, the feature of the first anti-reversible biasing member and the feature of the second anti-reversible biasing are held in place in the groove of the support;

wherein when the shade storage roll is rotated in a second direction, opposite the first direction, the groove of the support allows passage of the feature of the first anti-reversible biasing member and the feature of the second anti-reversible biasing member out of the groove so as to prevent reverse or back winding of the first anti-reversible biasing member and the second anti-reversible biasing member;

a motor assembly positioned the shade storage roll.

11. The apparatus of claim 10 wherein the first housing and the second housing have connectors and receivers that engage one another thereby holding the first housing and the second housing together.

12. The apparatus of claim 10 further comprising a first end cap and a second end cap wherein the first end cap is connected to the shade storage roll at a first end, and the second end cap is connected to the shade storage roll at a second end such that the first end cap and the second end cap are held stationary with the storage roll and rotate about the support with the storage roll.

13. The apparatus of claim 10 wherein further comprising a power supply positioned within the shade storage roll and electrically connected to the motor assembly.

14. The apparatus of claim 10 wherein an interior surface of the shade storage roll includes a male or female connector and the exterior surface of the first housing includes a corresponding male or male connector and wherein the male or female connector of the first housing is conformed to connect with the male or female connector of the shade storage roll so as to allow sliding of the first housing within the shade storage roll while preventing rotation of the first housing within the shade storage roll.

15. The apparatus of claim 10 the first anti-reversible biasing member is selected from a group consisting of: a spring and a coiled flat spring.

16. The apparatus of claim 10 wherein the groove of the support has a first side and a second side;

wherein the first side of the groove is sharp or concave in shape so as to hold the feature of the first anti-reversible biasing member when rotated in a first direction;

wherein the second side of the groove is smooth or convex in shape so as to allow the feature of the first anti-reversible biasing member to ramp over the groove when rotated in a second direction.

17. In a shade system with a bracket supporting a shade storage roll, a modular anti-reversible power spring apparatus comprising:

a first housing having an exterior surface, a receiver end and a connector end wherein the first housing encloses a first anti-reversible biasing member;

the first anti-reversible biasing member having a first end and a second end wherein the first end is connected to the first housing and the second end includes a feature;

a male or female connector in the exterior surface of the first housing;

a second housing having an exterior surface, a receiver end and a connector end wherein the second housing encloses a second anti-reversible biasing member;

the second anti-reversible biasing member having a first end and a second end wherein the first end is connected to the second housing and the second end includes a feature;

a male or female connector in the exterior surface of the second housing;

wherein the first housing and the second housing selectively lock to one another thereby preventing unintentional separation of the first housing and the second housing;

wherein the shade storage roll has a hollow interior, wherein a male or female connector is positioned in an interior surface of the shade storage roll that corresponds with the male or female connector in the exterior surface of the first housing and the second housing, wherein the male or female connector of the first housing is conformed to connect with the male or female connector of the shade storage roll so as to allow sliding of the first housing and the second housing within the shade storage roll while preventing rotation of the first housing and the second housing within the shade storage roll;

a support connected with the bracket;

the support having a groove;

wherein the feature of the first anti-reversible biasing member is received within the groove of the support and the feature of the second anti-reversible biasing member is received within the groove of the support;

wherein the shade storage roll rotates around the support;

wherein when the shade storage roll is rotated in a first direction, the feature of the first anti-reversible biasing member and the feature of the second anti-reversible biasing are held in place in the groove of the support;

wherein when the shade storage roll is rotated in a second direction, opposite the first direction, the groove of the support allows passage of the feature of the first anti-reversible biasing member and the feature of the second anti-reversible biasing member out of the groove so as to prevent reverse or back winding of the first anti-reversible biasing member and the second anti-reversible biasing member.

18. The apparatus of claim 17 further including:

a motor assembly positioned within the shade storage roll.

19. The apparatus of claim 17 further including a power supply positioned within the shade storage roll.

20. The apparatus of claim 17 further including:

wherein the groove of the support has a first side and a second side;

wherein the first side of the groove is sharp or concave in shape so as to hold the feature of the first anti-reversible biasing member when rotated in a first direction;

wherein the second side of the groove is smooth or convex in shape so as to allow the feature of the first anti-reversible biasing member to ramp over the groove when rotated in a second direction.

* * * * *